United States Patent [19]

Heins

[11] 4,173,454

[45] Nov. 6, 1979

[54] METHOD FOR REMOVAL OF SULFUR FROM COAL IN STOKER FURNACES

[76] Inventor: Sidney M. Heins, 6033 N. Sheridan Rd., Chicago, Ill. 60660

[21] Appl. No.: 964,619

[22] Filed: Nov. 29, 1978

Related U.S. Application Data

[63] Continuation-in-part of Ser. No. 816,310, Jul. 18, 1977, abandoned.

[51] Int. Cl.[2] ..... C10L 9/10

[52] U.S. Cl. ..... 44/1 SR; 44/5; 44/26; 110/342; 110/345

[58] Field of Search ..... 44/26, 1 SR, 5; 110/342; 75/42

[56] References Cited

U.S. PATENT DOCUMENTS

| | | | |
|---|---|---|---|
| 2,473,987 | 6/1949 | Brandon | 75/42 X |
| 2,800,172 | 7/1957 | Romer et al. | 75/42 X |
| 2,956,868 | 10/1960 | Burgess | 44/26 |
| 3,823,676 | 7/1974 | Cook et al. | 110/342 |
| 3,949,684 | 4/1976 | Copeland | 110/345 |
| 3,983,218 | 9/1976 | Heins | 423/244 |

*Primary Examiner*—Carl F. Dees
*Attorney, Agent, or Firm*—John R. Diver

[57] ABSTRACT

A low-cost method of taking sulfur out of coal in stoker furnaces comprising mixing the coal with natural-occurring flue dust from steel-making, pulverized red mud from aluminum-making, of pulverized retort residues from zinc-making, or a pulverized prepared material comprising principally the ferrites and oxides of certain minerals and at least a trace of ferric oxide as a catalyst for accelerating the conversion of sulfur dioxide to sulfur trioxide and heating the mixture in the combustion zone of the furnace in the presence of water vapor from the fuel to form sulfuric acid for oxidizing said natural-occurring or prepared sulfur dioxide absorbent materials into sulfates and precipitating the same along with ash in the fuel to the bottom of the furnace.

5 Claims, No Drawings

METHOD FOR REMOVAL OF SULFUR FROM COAL IN STOKER FURNACES

BACKGROUND OF THE INVENTION

This application is a continuation-in-part of application to METHOD FOR REMOVAL OF SULFUR DIOXIDE FROM HYDROCARBON FUELS AT THE POINT OF COMBUSTION, Ser. No. 816,310 filed July 18, 1977 and now abandoned.

The present clean air standards limit sulfur dioxide emissions from industrial and public utility power plant furnaces. Plants burning commercial-grade coal presently use scrubbers to remove the sulfur after burning or a coal cleaning process called solvent-refining to remove it before. Although solvent-refining has the advantage of taking the pollutants out of coal before it is burned instead of afterwards, it can currently just meet present sulfur emission standards which the EPA is required to set more stringently as the best-available technology evolves.

On the other hand, capital costs involved with the installation of scrubber equipment are huge.

This invention covers a new and unobvious development in the art over that covered in my U.S. Pat. No. 3,983,218 for METHOD FOR DRY REMOVAL OF SULFUR DIOXIDE FROM FURNACE FLUE, COAL AND OTHER GASES.

SUMMARY OF THE INVENTION

The gist of this invention lies in a process for reducing the sulfur emissions from stoker furnaces using briquets and/or pellets of coal and a sulfur dioxide absorbent that are burned on the fuel-bed of the furnace to remove the sulfur just after its combustion but before the ignition of the hydrocarbons in the coal; which briquets and/or pellets comprise at least a stochiometric mix of pulverized commercial coal and a pulverized prepared sulfur dioxide absorbent selected from the group consisting of ferrites and mineral oxides, or a pulverized natural-occurring sulfur dioxide absorbent selected from the group consisting of tailings from the mining of zinc, copper or manganese ore, flue dust from steel-making, pulverized red mud from aluminum-making and pulverized retort residue from zinc-making; the said mix having roughly the ratio of four parts of coal to two parts of the natural-occurring material; wherein said burning involves the chemical union of sulfur dioxide, formed from the oxidation of the sulfur in the coal at 684° F. in the combustion zone of the furnace, with oxygen in the air in the presence of a trace of ferric oxide to form sulfur trioxide, which trioxide further reacts with water vapor from released hygroscopic water in the raw coal to form the bivalent sulfate group in vaporized sulfuric acid; said sulfur being precipitated from the fuel bed as sulfates which are the oxidation product of said absorbent material and said sulfuric acid, and which drop as conglomerate solids with the ash in the coal to the bottom of the furnace while not substantially adding to the problem of fly ash removal from the flue gas out the stack.

DESCRIPTION OF THE PREFERRED EMBODIMENTS

The following examples illustrate various aspects of the invention.

EXAMPLE 1: $SO_2$ ABSORPTION USING FLUE DUST FROM STEEL-MAKING

According to the present invention, a typical sulfur-bearing commercial-grade Midwestern free-burning coal having the analysis shown in Table I is ground in a suitable pulverizer and sieved to −20 to −40 mesh and uniformly mixed with the flue dust from open hearth and basic oxygen steel-making furnaces having about 100 mesh size and finer in the ratio of four parts of coal to two of flue dust. The flue dust comprises up to 60% iron and 5–30% zinc in various chemical combinations and in addition contains small amounts of the oxides of calcium, magnesium, silicon and aluminum. From 60–90% of the available zinc is in the form of zinc-ferrite which comprises 3–27% of a typical flue dust. The rest of the zinc is in the form of zinc oxide. Manganese and nickel ferrites are also present in the flue dust, but only in relatively minor quantities.

TABLE I

| | TYPICAL ANALYSIS - AS RECEIVED | | | | | | APPOX ASH | |
|---|---|---|---|---|---|---|---|---|
| | | PERCENT | | | | | SOFTENER | GRINDABILITY |
| STATE | M | VOL | FC | ASH | SUL | BTU | TEMP °F. | (HARDGROVE) |
| ILL | 15.4 | 34.4 | 38.5 | 11.7 | 3.0 | 10,422 | 1970 | 65–67 |

A trace of pulverized ferric oxide is a necessary constituent in the flue dust as a catalytic agent, and should be added if it is not already present in the coal, because the chemical union of sulfur dioxide from the reaction of the sulfur in the coal with the oxygen in the air supplied to the furnace for burning is normally so slow that it requires the presence of a catalyst to form sulfur trioxide at a rate sufficient to be useful.

The resultant mix of pulverized Midwestern free-burning coal and flue dust from steel-making is compacted into briquets, having sizes varying from 1 to 1½ inches in diameter, to pellets of a size that will pass through a ¼ inch round screen and a size distribution coefficient of 1.0 in a conventional manner by mixing with a binder, or by pressure. The briquets and/or pellets are burned on the fuel bed of a furnace.

The removal of sulfur from burning coal in the zone of combustion in the fuel bed of the furnace with flue dust from steel-making is qualitatively effected and quantitatively completed by the pulverization and complete mixing of the solid flue dust and the sulfur in the coal into many small particles each with chemical affinity for adjacently disposed particles so as to expose as much surface of each contained in the coal as possible to heat and air and to the chemically active surface of its counterpart. In this way the oxidation of the resulting sulfur to sulfur dioxide with the oxygen in the air supplied to the furnace for burning can best take place, and in this way the bivalent sulfate group can more readily penetrate the solid flue dust particulate surface to break away and hook up with atoms of iron, zinc, manganese or nickel therein and precipitate the sulfates of these elements therefrom. For similar reasons, the catalytic oxidation of sulfur dioxide to sulfur trioxide in the combustion zone requires the presence of ferric oxide in pulverulent form completely mixed with that of the coal and flue dust.

Sulfur trioxide as a gas reacts with dry water vapor from the coal to form dry sulfuric acid vapor. The chemical reaction products of this process precipitate the sulfur from the coal on the fuel bed along with the ash as the sulfate products of the sulfuric acid with the ferrites of zinc, manganese and nickel in the flue dust. Zinc sulfate, having a melting point of 1364° F., comes out as a solid. Ferric sulfate, as a byproduct useful in fertilizer applications, conglomerates out initially as a liquid but solidifies at 896° F.

EXAMPLE 2: $SO_2$ ABSORPTION USING PREPARED ABSORBENT

Another aspect of this invention lies in a process for reducing the sulfur emissions from coal-fired furnaces using briquets and/or pellets of fuel that are burned on the fuel bed of a furnace, which fuel comprises a pulverized commercial coal uniformly mixed in roughly the stochiometric ratio or four parts of coal to one part of a pulverized prepared absorbent material selected from at least one of the following groups:

(a) a ferrite having a trace of ferric oxide mixed therewith selected from the ferrites of zinc, manganese, nickel, lead, calcium and sodium; (b) a mineral oxide selected from the oxides of iron, aluminum, sodium, silicon and titanium; and (c) a mineral oxide selected from the oxides of the spinel group having the general composition $AB_2O_4$ wherein A consists of the elements magnesium, iron, zinc, tin, titanium and manganese or any combination thereof, and B consists of the elements aluminum, iron and chromium; wherein the burning of said coal involves the chemical union of sulfur dioxide from the oxidation of the sulfur in the coal, which reacts with air supplied oxygen in the presence of ferric oxides in said fuel as a catalytic agent, to form sulfur trioxide which further reacts with the water vapor from the raw coal to form sulfuric acid. The sulfuric acid then combines with the absorbent material to form sulfates which, upon conglomeration and solidification, precipitate along with the ash in the coal to the bottom of the furnace without substantially adding to the problem of fly ash removal from the flue gas out the stack.

EXAMPLE 3: $SO_2$ ABSORPTION USING PULVERIZED RED MUD FROM ALUMINUM-MAKING

Four parts of commercial-grade Midwestern coal, having the analysis shown in Table I, is pulverized and uniformly mixed with approximately two parts of pulverized red mud which is what is left after alumina has been dissolved out of bauxite ore in a caustic solution and the residue dried. A trace of pulverized ferric oxide is added, if necessary because of the lack of its presence in the coal. The mix is briquetted and burned on the fuel bed of a furnace.

Sulfur trioxide as a gas reacts with dry water vapor in the coal in the zone of combustion to form dry sulfuric acid vapor. The sulfur precipitates from the fuel bed of the furnace under gravity as sulfates of iron and other minerals which are present in the red mud, and drop upon cooling along with the ash from the coal to the bottom of the furnace.

EXAMPLE 4: $SO_2$ ABSORPTION USING PULVERIZED RETORT RESIDUE FROM ZINC-MAKING

Four parts of commercial-grade Midwestern coal, having the analysis shown in Table I, is pulverized and uniformly mixed with approximately two parts of pulverized retort residue from zinc-making, which is what is left over after concentrating the ores (sphalerite, zincite, smithsonite, willemite and franklinite), roasting, and either sintering or condensing the zinc and drying the residue. A trace of pulverized ferric oxide is added, if necessary because of the lack of its presence in the ash of the coal. The mix is briquetted or pelletized and burned on the fuel bed of the furnace.

The removal of sulfur from burning coal in the zone of combustion in the fuel bed of the furnace with retort residue from zinc-making is most qualitatively effected and quantitatively completed by the pulverization of the sulfur in the coal into many small particles so as to expose as much surface of the sulfur contained in the coal as possible to heat and air, in order that the oxidation of the resulting gasification of sulfur to sulfur dioxide with the oxygen in the air supplied to the furnace for burning can best take place. The further oxidation of the sulfur dioxide so formed to sulfur trioxide in the zone of combustion likewise needs pulverulent ferric oxide as a catalyst.

Sulfur trioxide as a gas again reacts with dry water vapor from the raw coal in the combustion zone of the furnace to form dry sulfuric acid vapor. The sulfur precipitates from the fuel bed of the furnace under gravity as sulfates of iron, and other minerals which are present in the retort residue, and drop upon cooling along with the ash from the coal to the bottom of the furnace.

EXAMPLE 5: $SO_2$ ABSORPTION USING PULVERIZED TAILINGS FROM THE MINING OF ZINC, COPPER OR MANGANESE ORE

Four parts of commercial-grade Midwestern coal, having the analysis shown in Table I, is pulverized and uniformly mixed with approximately two parts of pulverized tailings from the mining of zinc, copper or manganese ore, comprising the gangue and other refuse material resulting from the washing, concentration or treatment and drying of ground ore. A trace of pulverized ferric oxide is added, if necessary. The mix is briquetted and burned on the fuel bed of a furnace. During combustion the sulfur in the coal is converted to sulfur dioxide and in the presence of ferric oxide to sulfur trioxide which combines with the water vapor from the raw coal to form dry sulfuric acid vapor, which further reacts with the pulverized tailings to form sulfates of iron and other minerals present in the said tailings, and these sulfates are precipitated to the bottom of the furnace with the ash of the coal.

Although several examples of the invention herein disclosed have been described, it will be understood that the inventive concept disclosed may be carried out by other procedures without departing from the spirit of this invention as defined by the following claims.

I claim:

1. A method of removal of sulfur from coal having released hygroscopic moisture from the combustion zone in the fuel bed of a stoker furnace wherein the temperature is between the oxidation temperature of the sulfur and the ignition temperature of the coal comprising the steps:

(a) Pulverizing the coal;

(b) Pulverizing a mineral oxide selected from the oxides of the spinel group having the general composition $AB_2O_4$ wherein A consists of the mineral elements magnesium, iron, zinc, tin, titanium and manganese or any combination thereof, and B consists of the mineral elements aluminum, iron and chromium, both groups of mineral elements with electrode potential above that of hydrogen;

(c) Mixing the pulverulent coal and at least a stoichiometrically correct amount of the pulverulent mineral oxide, one of which contains at least a trace of a pulverized catalytic agent for oxidizing sulfur dioxide;

(d) Introducing the pulverulent mix of coal, mineral oxide and catalytic agent into the combustion zone of said furnace; and (e) Precipitating the sulfur from the zone of combustion as the sulfates of the mineral elements in the selected mineral oxide.

2. A method of removal of sulfur from coal as set forth in claim 1 wherein the step of introducing the pulverulent mix of coal, mineral oxide and catalytic agent into the combustion zone of said furnace comprises the step:

(a) Compacting said mix in a form as selected from the form group consisting of briquets and pellets.

3. A method of removal of sulfur from coal as set forth in claim 1 wherein the mineral oxide from the spinel group comprises:

(a) A natural-occurring material selected from the group consisting of flue dust from steel-making containing ferrite, red-mud from aluminum-making, retort residue from zinc-making and tailings from the mining of ores of zinc, copper or manganese.

4. A method of removal of sulfur from coal as set forth in claim 3 wherein the mix of the pulverulent coal and the flue dust from steel-making comprises a ratio of approximately four parts of coal to one of flue dust.

5. A method of removal of sulfur from coal as set forth in claim 1 wherein the catalytic agent for oxidizing sulfur dioxide comprises ferric oxide.

* * * * *